US009963334B2

(12) United States Patent
Wood

(10) Patent No.: US 9,963,334 B2
(45) Date of Patent: May 8, 2018

(54) COASTER BOTTLE CAP REMOVER

(71) Applicant: James Adam Wood, Maple Ridge (CA)

(72) Inventor: James Adam Wood, Maple Ridge (CA)

( * ) Notice: Subject to any disclaimer, the term of this patent is extended or adjusted under 35 U.S.C. 154(b) by 281 days.

(21) Appl. No.: 14/860,545

(22) Filed: Sep. 21, 2015

(65) Prior Publication Data

US 2016/0083237 A1 Mar. 24, 2016

Related U.S. Application Data

(60) Provisional application No. 62/053,090, filed on Sep. 19, 2014.

(51) Int. Cl.
*B67B 7/16* (2006.01)
*A47G 23/03* (2006.01)

(52) U.S. Cl.
CPC ..... *B67B 7/16* (2013.01); *A47G 23/03* (2013.01); *A47G 23/0306* (2013.01)

(58) Field of Classification Search
CPC ..... A47G 23/03; A47G 23/0306; A47G 23/0216; B67B 7/16
See application file for complete search history.

(56) References Cited

U.S. PATENT DOCUMENTS

| | | | | | |
|---|---|---|---|---|---|
| 937,850 | A * | 10/1909 | Parker | A47G 23/03 | 220/212 |
| 2,955,722 | A | 10/1960 | Antonious | | |
| 4,414,865 | A | 11/1983 | Brooks | | |
| D278,406 | S | 4/1985 | Koziol | | |
| 4,829,618 | A * | 5/1989 | McKee | A47G 23/03 | 248/346.11 |
| 5,150,869 | A * | 9/1992 | Gould | A47G 19/2205 | 215/228 |
| 6,834,394 | B2 | 12/2004 | Macdonald | | |
| 7,264,134 | B2 * | 9/2007 | Tulp | A47G 23/0216 | 220/739 |
| 7,343,834 | B2 * | 3/2008 | Howlett | A47G 23/0216 | 215/390 |
| 7,404,345 | B1 | 7/2008 | Dipprey | | |
| 7,685,908 | B1 | 3/2010 | Sebastion et al. | | |
| D660,090 | S | 3/2012 | Lane | | |
| 9,254,053 | B2 * | 2/2016 | Arzumanyan | A47G 23/0306 | |
| 2004/0123722 | A1 * | 7/2004 | Cohen | A47G 23/0306 | 84/410 |

(Continued)

FOREIGN PATENT DOCUMENTS

| | | |
|---|---|---|
| DE | 202008012693 | 1/2009 |
| JP | 2006273422 | 10/2006 |

*Primary Examiner* — David B Thomas
(74) *Attorney, Agent, or Firm* — Steven R. Gray; Holland & Hart LLP

(57) ABSTRACT

A coaster device for removing a cap from a bottle and method of doing the same. One coaster device may comprise a top side and a bottom side, and at least one aperture extending from the bottom side to the top side, the aperture having at least one edge configured to engage the fastened cap to remove the cap from the bottle. In some embodiments, the aperture may comprise at least part of a stylized design. Also a method of advertising using a bottle-opening coaster device that includes a bottle-opening edge forming at least part of a stylized design as part of a logo.

20 Claims, 4 Drawing Sheets

(56) References Cited

U.S. PATENT DOCUMENTS

| | | | | |
|---|---|---|---|---|
| 2006/0016294 | A1* | 1/2006 | McGrath | A47G 23/0216 81/3.09 |
| 2006/0016820 | A1 | 1/2006 | Himes | |
| 2006/0075770 | A1 | 4/2006 | Lefkowitz | |
| 2007/0012140 | A1 | 1/2007 | Howlett | |
| 2008/0098853 | A1 | 5/2008 | Choate | |
| 2008/0237242 | A1* | 10/2008 | Gifford | A47G 23/0216 220/592.16 |
| 2014/0166672 | A1* | 6/2014 | Stroucken | B67B 7/00 220/592.01 |
| 2014/0263336 | A1* | 9/2014 | Hicks | A47G 19/22 220/284 |

* cited by examiner

FIG. 1
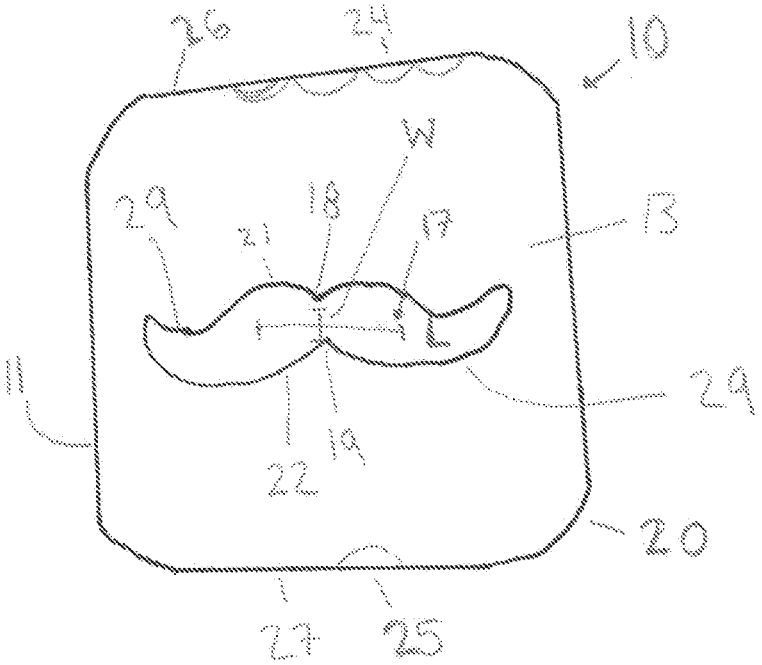
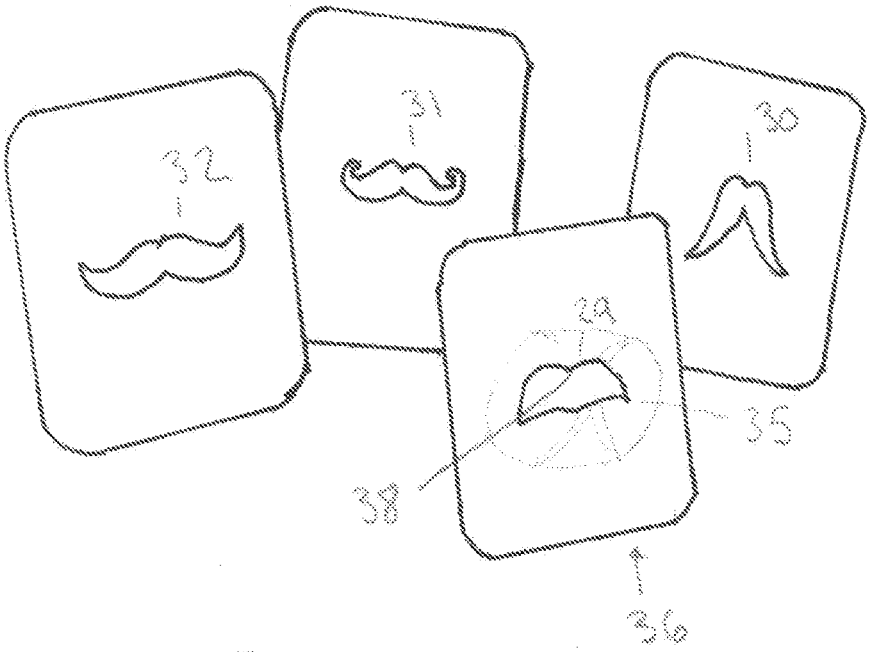
FIG. 2

FIG. 3
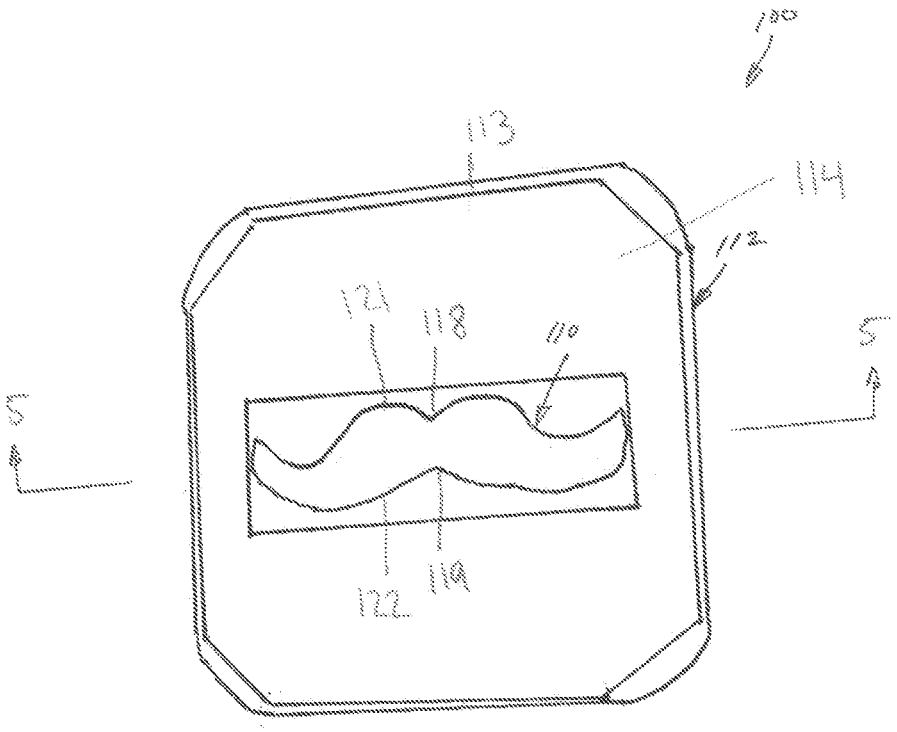
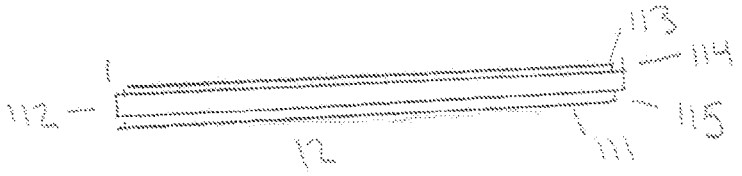
FIG. 4
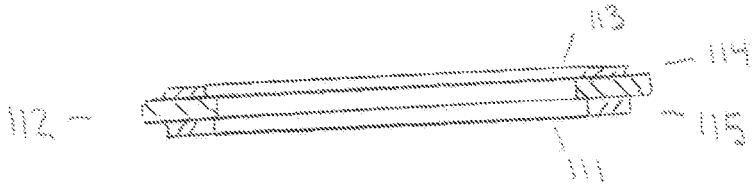
FIG. 5

FIG. 6
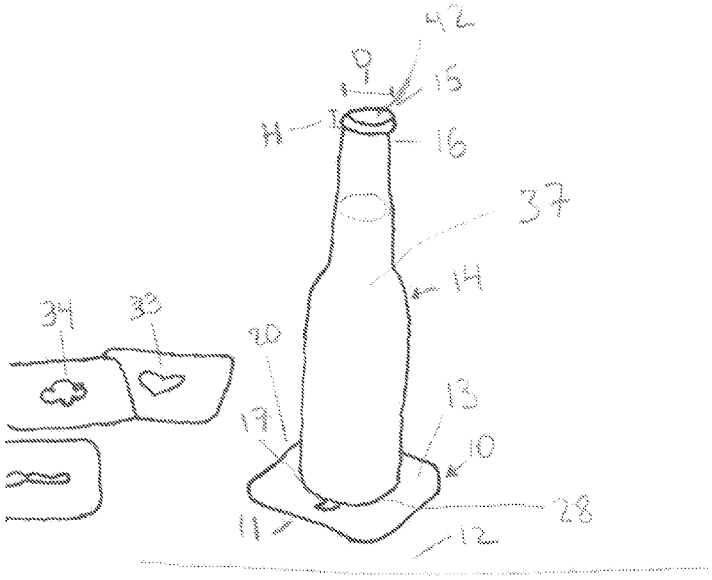
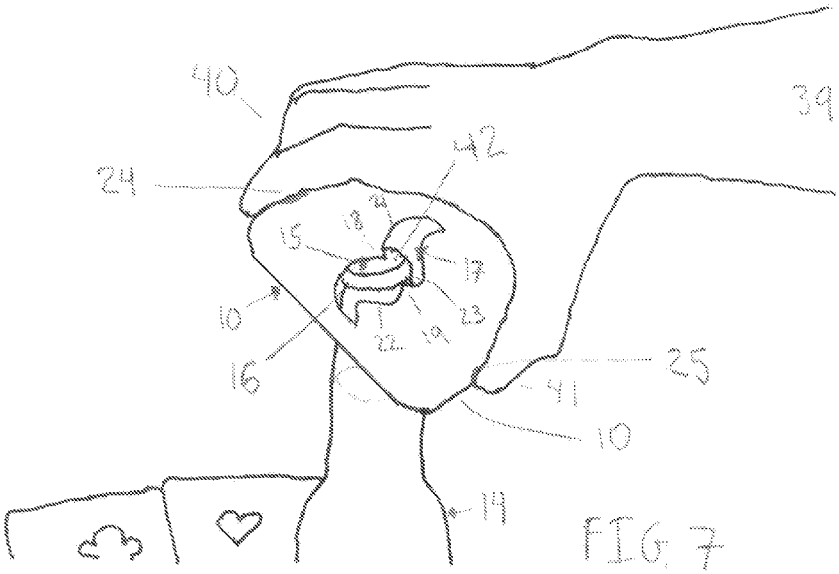
FIG. 7

FIG. 8
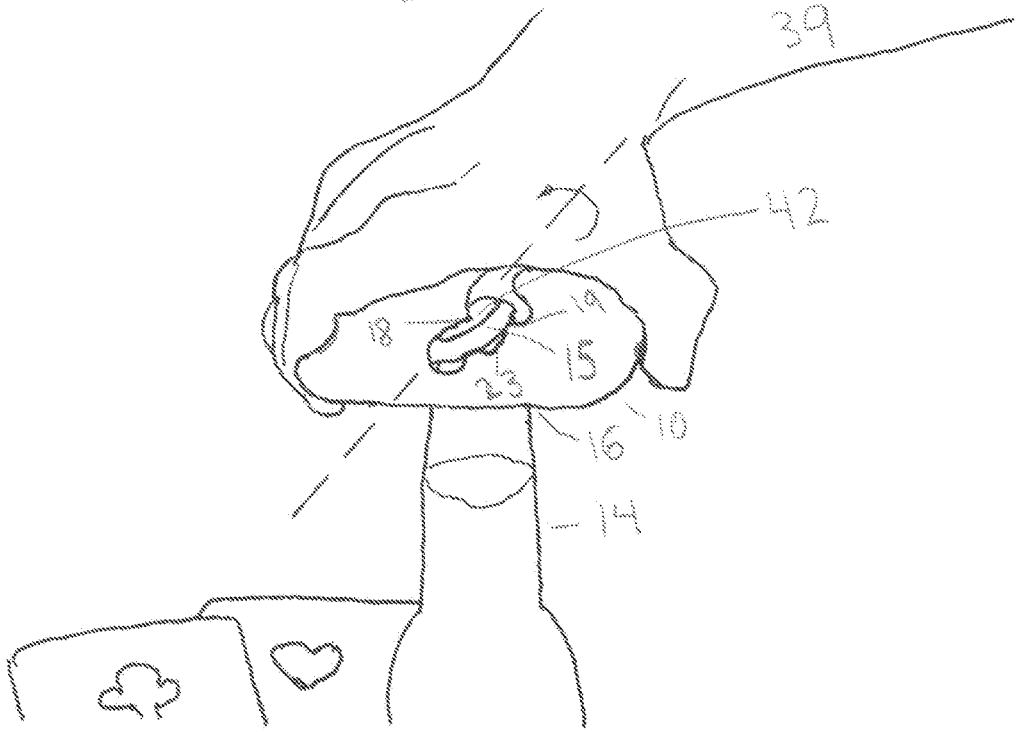
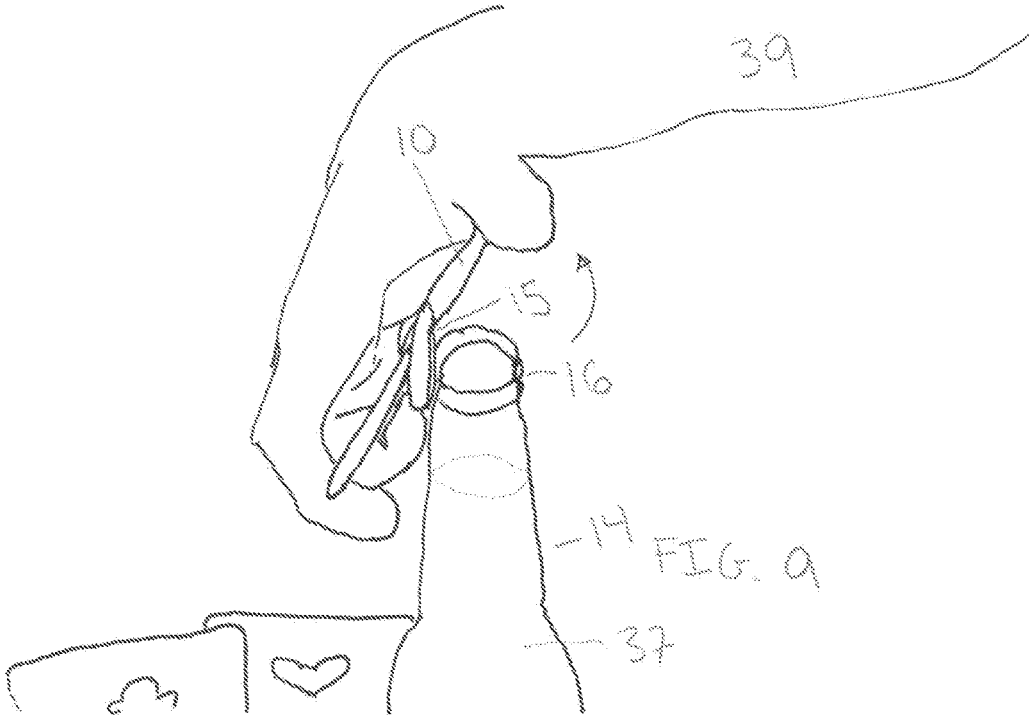
FIG. 9

COASTER BOTTLE CAP REMOVER

CROSS-REFERENCE TO RELATED APPLICATION

This application claims the benefit of the filing date of U.S. Provisional Application No. 62/053,090, filed Sep. 19, 2014, and entitled COASTER BOTTLE CAP REMOVER, the disclosure of which is incorporated, in its entirety, by reference.

FIELD OF THE INVENTION

This present disclosure generally relates to bottle opening devices, and more particularly relates to coaster devices having bottle opening features as well as advertising methods using such devices.

BACKGROUND

A bottle opener uses a point on the bottle cap as a fulcrum on which to pivot, acting as a lever with an edge applying force under one side of the bottle cap to pry the bottle cap off the top portion of the bottle. One problem associated with bottle openers is, whether due to misplacement of a bottle opener, theft, or lack of forethought, a bottle opener is often not in close proximity when it is needed. Consequently, many people have resorted to a variety of less effective and potentially dangerous methods to remove a bottle cap from a bottle, including for example: using scissors to cut under the ridges of a bottle cap; pushing the cap against the recessed coin return part of a vending machine; wrapping a rubber band around the edges of the cap and twisting hard; or otherwise trying to pry under the bottle cap using various objects (such as a spoon, knife, fork, belt buckle, ice skates, car seat belt latches, metal nail clippers, a peeler, a hammer, a staple remover, a non-gold wedding ring, a screwdriver, or even the cap attached to another bottle). Such alternate devices for removing a cap from a bottle may have prompted the different forms that bottle openers have taken in recent years (probably beginning in the 1980s) such as a baseball cap with bottle opener in the visor, a sole of a flip flop, a surfboard shape, or shapes representing different sports, a guitar, or a cowboy boot.

Even when a bottle opener is available but not in close proximity, having to obtain the bottle opener may be inconvenient, especially when this requires interrupting an engaging conversation, watching an exciting game or movie, or other activity, which may require having to get up from a comfortable sedentary position. Perhaps for these reasons, some devices have been created to combine a bottle opener with other presumably-useful objects, such as insulated beverage containers and even some coasters.

Opportunities exist for improving bottle opening devices and methods that address these and other issues.

SUMMARY

One aspect of the present disclosure relates to a coaster device and associated methods for removing a cap from a bottle. Another aspect of the present disclosure relates to a method of advertising using bottle-opening coaster device embodiment. The coaster device may be for placement on a surface and for stably supporting a bottle thereon, the bottle having a top part with a removable cap fastened thereon. The device may comprise a top side and a bottom side, and in one embodiment comprise at least one aperture extending from the bottom side to the top side. The at least one aperture may have at least one edge configured to engage the fastened cap to remove the cap from the bottle. The at least one aperture may be sized to receive a sufficient portion of the top part of the bottle and the cap fastened thereon to engage the cap with the edge.

One device embodiment may further comprise finger grips formed along a perimeter edge of the device, the finger grips providing a grasping surface for a user. In one device embodiment, the at least one edge of the may comprise metal. In another embodiment, the at least one edge may also comprise a metal layer extending to the perimeter edge of the device. The device top side in one embodiment may comprise a material or structure that limits transfer of condensation from the bottle to the surface. Additionally, in some embodiments, the at least one aperture of the coaster device may comprise at least part of a stylized design, which design in some variations may comprise a logo. In such embodiments having an aperture comprising at least one bottle-opening edge forming at least a portion of a logo, the aperture may or may not extend from the bottom side through to the top side (or vice versa).

Also described herein is a method of using coaster device embodiments to remove a fastened bottle cap from a top part of a bottle. One method embodiment may comprise the steps of: (1) fitting at least a portion of top part of the bottle and the cap fastened thereon within the at least one aperture; (2) engaging the fastened cap with the edge of the at least one aperture; and (3) pivoting the coaster device relative to the bottle using a portion of the bottle cap as a fulcrum, thereby applying force under one side of the bottle cap to lift the one side of the cap relative to the top part of the bottle. In the case of a coaster device embodiment comprising finger grips positioned along a perimeter edge of the device, the method the step of pivoting the coaster device relative to the bottle using a portion of the bottle cap as a fulcrum may involve grasping the coaster device using the finger grips.

Also claimed and described herein is a method of advertising using coaster device embodiments with at least one aperture comprising at least part of a stylized design. The advertising method may comprise the step of engaging the bottle cap with the at least one bottle opening edge with the coaster device arranged so that the at least a portion of the logo is visible, as well as pivoting the coaster device relative to the bottle using the bottle cap as a fulcrum to apply a lifting force under one side of the bottle cap to remove the bottle cap from the bottle. In the case of coaster device embodiments comprising at least one aperture extending from the bottom side through to the top side and comprising the at least one bottle opening edge, the method may further comprise the step of fitting at least a portion of a top part of the bottle and the bottle cap fastened thereon within the at least one aperture, prior to engaging the bottle cap with the at least one bottle opening edge.

BRIEF DESCRIPTION OF THE DRAWING

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

FIG. 1 is a perspective view of a coaster device configured to remove a cap from a bottle, the bottle cap removing feature(s) of the coaster device being disguised as a part of an aperture having a stylized design.

FIG. 2 is a perspective view of several coaster device embodiments for removing caps from bottles, each bearing a different design.

FIG. 3 is a top view of a coaster device configured to remove a cap from a bottle.

FIG. 4 is a side view of the coast device shown in FIG. 3.

FIG. 5 is a cross-sectional view of the coaster device shown in FIG. 3 taken along cross-section indicators 5-5.

FIG. 6 shows the coaster device embodiment of FIG. 1 with a bottle resting thereon.

FIGS. 7-9 show several steps of a method for using the coaster device embodiment of FIG. 6 to remove a cap from bottle, as well as a method of advertising.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

Referring to the figures, a device 10 is disclosed herein having in combination features of both a coaster and a bottle opener for removing a cap 15 from a bottle top 16 (see FIGS. 1-9). More specifically, as shown in FIGS. 1 and 6, the device 10 may comprise a flat bottom side 11 for placement on a flat surface 12 to protect the surface 12, and a top side 13 configured for placing a bottle 14 thereon. The device 10 may further comprise an aperture 17 passing through both the bottom side 11 and the top side 13. The aperture 17 includes at least one edge 18 (a first edge) configured to engage with the cap 15 for removal of the cap 15 from the bottle 14 (e.g., in the manner shown in FIGS. 7-9). The aperture 17 may have a size such that a sufficient portion of the bottle top 16 (or top part) and the cap 15 fastened thereon may fit within the aperture 17, to allow the cap 15 to engage with the edge 18 so that it 15 is removed/unfastened from the bottle top 16.

The aperture 17 may comprise a length L greater than the cap's diameter D (see FIG. 1). Moreover, the aperture 17 may be defined by at least a first side 21 and a second side 22 (regardless of shape of those sides—i.e., whether the sides are curved or straight, or otherwise styled). At least one portion of the first side 21 may be opposite from at least one portion of the second side 22. Those opposite portions of the first 21 side and the second side 22 may be separated by a width W greater than the cap's height H. The aperture 17 may further comprise at least the first edge 18 and a second edge 19, each on opposite portions of first side 21 and the second side 22, respectively. As shown in FIG. 7, the first edge 18 may be configured to pivot the coaster device 10 relative to the bottle 14 using the bottle cap 15 as a fulcrum. The second edge 19 may be configured for contacting and applying a lifting force to a bottom ridge 23 of the cap 15 to remove the bottle cap 15.

In some embodiments, the edges 18 and 19 may comprise metal or other material with sufficient strength and durability for repeated use in removing a bottle case. In some embodiments, the edges 18 and 19 may comprise part of a metal layer 20 of the device 10. The metal layer 20 may comprise the bulk if not the entire device 10 (i.e., the base), and in one embodiment. The metal material of device 10 may comprise, for example, stainless steel.

The edges 18 and 19 may have a contoured or curved shape, or include a contoured or curved portion along their lengths. In other embodiments, at least a portion of one or both of the edges 18 and 19 may have a linear or straight shape. A single device 10 may have a plurality of edges 18 and/or 19, wherein each of the edges 18 and/or 19 may have a contoured or linear portion.

Certain embodiments of the device 10 may incorporate other features for removing the cap 15 from a bottle 14. For example, in one embodiment, the device 10 may incorporate finger-grips 24 and 25 along perimeter edges 26 and 27 of the device 10 (or elsewhere) for greater control when using the device 10 to open a bottle 14.

The device 10, and other embodiment thereof, may include several beneficial features as compared to at least some prior art devices. For example, the device 10 may assist in solving the aforementioned problem of not having a bottle opener when needed because coasters are so commonly used when serving beverages. More specifically, coasters are generally located in areas where drinking is intended to take place, in particular drinking of beverages contained in bottles having removable caps. Thus, a person in such an area wanting to open a bottle 14 need not have to move to a different area for the purpose of obtaining a bottle opener. In fact, a person already using the coaster need not even use a separate bottle opening device.

The bottle opener feature of certain device embodiments comprising an aperture 17 passing through both top side 13 and bottom side 11 may also present certain benefits over other hybrid coaster/bottle openers. For instance, the device embodiment 10 comprising a metal layer or layer of other relatively hard material to assist in repeatedly removing bottle caps may be simpler and less expensive to manufacture since the aperture(s) 17 may simply be punched or cut (e.g., by laser) out of a metal sheet, as opposed to other prior art devices having several different parts needed opening a bottle 14. In addition, an embodiment of device 10 having a single metal layer 20 may be sturdier and less prone to breaking. In addition, the device 10 comprising an aperture 17 may be easier to clean than other bottle opening devices that require cleaning of nooks and crannies of a recess, and may be less prone to rust as moisture is more prone to reside on features of aperture 17.

Providing an aperture (e.g., aperture 17) passing through both top and bottom sides of a coaster is typically not desirable. Specifically, when a bottle (or a cup, glass, bottle, mug, etc.) is filled with a cool beverage, moisture may condense along the perimeter of the bottle. Such condensation can conglomerate and drip from the sides of the bottle and onto the surface upon which the bottle is placed (e.g., a table surface, etc.), possibly damaging or staining the surface. Coasters are typically designed to have a top surface that is continuous and without openings in order to avoid condensation escaping from the top surface of the coaster and onto the supporting surface (e.g., table top).

However, this apparent problem of having moisture passing through an aperture of a coaster may be overcome by several material or structural features disclosed herein. By way of example and not limitation, as shown in FIG. 3, device 100 includes a condensation absorbent material 114 positioned on the top side 113, and/or a bottom side platform 115 configured to suspend the bottom side 111 off the surface 12. The coaster device 100 may include a metal base 112 that separates the condensation absorbent material 114 on the top side 113 from the platform 115 on the bottom side. Moreover, the metal base 112 may comprise the edges 118, 119 located on opposite sides 121, 122 of the aperture 110.

In addition to the foregoing, the coaster device 100 may include one or more of the following features: (1) a top side surface of the coaster device may be larger than the bottom circumference 28 of the bottle, so that the bottle 14 may be placed in an area of the top side surface that does not overlap with the at least one aperture 17; (2) a rim surrounding the at least one aperture and extending above the top side; (3) a recess formed in the top surface to direct condensation away from the at least one aperture or other structure for funneling condensation away from the aperture(s); and/or (4) a cap configured to cover the at least one aperture.

Another reason it may be counterintuitive to include apertures in a coaster is to limit heat damage to supporting the surface (e.g., table top). Specifically, when containers are filled with hot liquid (as opposed to cold or non-hot), heat can emanate from the container and more easily through apertures formed in the coaster, which can also damage the surface. However, for coasters having bottle opening features, this is not as large of a concern because bottles (e.g., bottle 14) having caps (e.g., cap 15) fastened thereon are not normally used for storing hot liquids.

Referring now to FIGS. 6-9, a method of removing a cap 15 from a bottle 14 using coaster device embodiments is described in further detail. As shown in FIG. 7, a user 39 may grasp the coaster device 10, placing fingers 40, 41 in the finger grips 24, 25 formed along a perimeter edge 26, 27 of the device 10. Next, at least a portion of top part 16 of the bottle 14 and the cap 15 fastened thereon may be fitted within the at least one aperture 17 of the coaster device 10 (e.g., so that the cap diameter D is within the aperture length L and the cap height H within the aperture width W). The first edge 18 may be placed touching the top 42 of the bottle cap 15, and the second edge 19 may be placed touching beneath the bottom ridge 23 of the cap 15.

Next, as shown in FIG. 8, the user 39 may to pivot the coaster device 10 relative to the bottle 14 so that the first edge 18 uses the top 42 of the bottle cap 15 as a fulcrum, thereby applying force through the second edge 19 under the bottom ridge 23 of the cap 15 to lift the one side of the cap 15 relative to the top part 16 of the bottle 14. As shown in FIG. 9, as the user 39 continues the motion of pivoting the coaster device 10 relative to the bottle 14, the cap 15 is removed from the top part 16 of the bottle 14, allowing the user 39 to enjoy the refreshing beverage 37 in bottle 14, and again placing the coaster device 10 beneath the bottle 14 to protect the surface 12 (FIG. 6).

The device 10 may comprise at least one aperture 17, edges 18 and 19, and sides 21, 22 thereof that define a shape comprising a design 29. The device 10 with design 29 may be referred to as a "novelty bottle opener" comprising a coaster. In some embodiments, the design 29 may camouflage to the casual observer the functionality of the aperture 17 and edge(s) 18, 19 to remove the cap 15 from the bottle 14, and potentially making the device 10 more aesthetically appealing. Appearance, shape, and materials of the device may vary according to preference and embodiment, and are not limited to those shapes and designs 29, 30, 31, 32, 33, 34 shown in FIGS. 1, 2 and 6. Nevertheless, one embodiment may comprise a modern industrial looking beverage coaster bearing a customized logo or design, where the bottle opener portion of the logo/design is discreet.

For example, as shown in FIG. 2, one coaster device 36 may have an aperture shape and design 29 comprising a logo 35. The device 36 may be advantageous for advertising purposes because, although a company may create a variety of promotional items such as coasters to advertise and market its services and increase its goodwill with consumers, often the objects may be used with little thought or recognition of the company name emblazoned thereon. However, a device 36 comprising bottle opening features with an edge 38 for removing the cap 15 from the bottle 14 as an integral part of a company's logo 35, may cause immediate and inescapable attention to be drawn to the logo 35 each time a bottle 14 is opened. Such a feature and process may not only constitute more effective advertising as explained, but may also connect in the mind of the consumer the company logo 35 with the pleasure of enjoying a refreshing beverage 37 (e.g., shown in FIG. 1) without the inconvenience of having to find a separate bottle opener. In addition, in embodiments where the design or logo may have particular significance to the user (e.g., in the case of customized designs or logos), the experience may be even more satisfying. Thus, the steps described above for opening a bottle using coaster device embodiment are likely to draw the attention of the user's 39 to the design of which the aperture 17 may form at least a part. Accordingly, described herein is not only a method of removing a cap 15 from a bottle 14 using coaster device embodiments, but also a novel method of advertising using device embodiments having at least one aperture comprising a logo. Thus, for device 36 where the design comprises a logo 35, the method may be used for more effective promotional purposes.

Various inventions have been described herein with reference to certain specific embodiments and examples. However, they will be recognized by those skilled in the art that many variations are possible without departing from the scope and sprit of the inventions disclosed herein, in that those inventions set forth in the claims below are intended to cover all variations and modifications of the inventions disclosed without departing from the spirit of the inventions. The terms "including" and "having" come as used in the specification and claims shall have the same meaning as the term "comprising."

I claim:

1. A coaster device for placement on a surface and for stably supporting a bottle thereon, the bottle having a top part with a removable cap fastened thereon, the device comprising:

a top side and a bottom side;

at least one aperture extending from the bottom side to the top side, the at least one aperture having at least one edge configured to engage the fastened cap to remove the cap from the bottle, wherein the at least one edge comprises a metal layer;

wherein the at least one aperture is sized to receive a sufficient portion of the top part of the bottle and the cap fastened thereon to engage the cap with the edge.

2. The coaster device of claim 1, wherein the cap has a diameter and a height and a bottom ridge, and the aperture comprises a length greater than the cap diameter and at least a first side and a second side, the first side opposite from the second side and separated by a width greater than the cap height; the aperture further comprising at least a first edge and a second edge, the first edge on the first side and the second edge on the second side, the first edge for pivoting the coaster device relative to the bottle using the bottle cap as a fulcrum, and the second edge for applying a lifting force to the cap's bottom ridge to remove the bottle cap.

3. The coaster device of claim 1, wherein the at least one edge comprises metal.

4. The coaster device of claim 1, further comprising finger grips formed along a perimeter edge of the device, the finger grips providing a grasping surface for a user.

5. The coaster device of claim 1, wherein the top side comprises a material or structure that limits transfer of condensation from the bottle to the surface.

6. The coaster device of claim 5, wherein the material or structure comprises a size for the top surface that accommodates the bottle without the bottle overlapping the at least one aperture.

7. The device of claim 5, wherein material or structure comprises a rim surrounding the at least one aperture and extending above the top side.

8. The coaster device of claim 5, wherein the material or structure comprises a condensation absorbent material positioned on the top side.

9. The coaster device of claim 5, wherein material or structure comprises a recess formed in the top surface to direct condensation away from the at least one aperture.

10. The coaster device of claim 5, wherein the material or structure comprises a cap configured to cover the at least one aperture.

11. The coaster device of claim 5, wherein the material or structure comprises a bottom side platform configured to suspend the bottom side off the surface.

12. The coaster device of claim 1, wherein the at least one aperture comprises a stylized design.

13. The coaster device of claim 12, wherein the stylized design comprises a logo.

14. A method of using a coaster device to remove a fastened bottle cap from a top part of a bottle, the coaster device comprising a top side for stably placing the bottle thereon, a bottom side for placing on a surface, and at least one aperture extending from the bottom side to the top side, the at least one aperture having at least one edge, the method comprising:

fitting at least a portion of a top part of the bottle and the cap fastened thereon within the at least one aperture;

engaging the fastened cap with the at least one edge of the at least one aperture, wherein the at least one edge comprises a metal layer;

pivoting the coaster device relative to the bottle using a portion of the bottle cap as a fulcrum thereby applying force under one side of the bottle cap to lift the one side of the cap relative to the top part of the bottle.

15. The method of claim 14, wherein the cap has a top surface, a diameter, a height, and a bottom ridge, and the aperture further comprises a length greater than the cap diameter and at least a first side and a second side, the first side opposite from the second side and separated by a width greater than the cap height; the aperture further comprising:

at least a first edge and a second edge, the first edge on the first side and the second edge on the second side;

the step of fitting at least a portion of top part of the bottle and the cap fastened thereon within the at least one aperture further comprising fitting the cap diameter within the aperture length and the cap height within the aperture width; and the step of engaging the fastened cap with the edge of the at least one aperture further comprising contacting the first edge against the top surface of the cap and contacting the second edge under the bottom ridge of the cap.

16. The method of claim 14, wherein the device further comprises finger grips positioned along a perimeter edge of the device, the finger grips providing a grasping surface for a user to hold the device when engaging the edge with the cap; and the step of pivoting the coaster device relative to the bottle using a portion of the bottle cap as a fulcrum further comprises grasping the coaster device using the finger grips.

17. A method of advertising using a coaster device, the coaster device comprising a top side for stably placing a bottle thereon, a bottom side for placing on a surface, and at least one bottle-opening edge forming at least a portion of a logo, the method comprising:

engaging the bottle cap with the at least one bottle opening edge with the coaster device arranged so that the at least a portion of the logo is visible;

pivoting the coaster device relative to the bottle using the bottle cap as a fulcrum to apply a lifting force under one side of the bottle cap to remove the bottle cap from the bottle.

18. The method of claim 17, wherein the device further comprises finger grips positioned along a perimeter edge of the coaster device, the finger grips providing a grasping surface for a user to hold the device during use.

19. The method of claim 17, wherein the coaster device further comprises at least one aperture extending from the bottom side to the top side and comprising:

the at least one bottle opening edge, the method further comprising, prior to the step of engaging the bottle cap with the at least one bottle opening edge, fitting at least a portion of a top part of the bottle and the bottle cap fastened thereon within the at least one aperture with the logo visible.

20. A coaster device for placement on a surface and for stably supporting a bottle thereon, the bottle having a top part with a removable cap fastened thereon, the device comprising:

a top side and a bottom side;

at least one aperture extending from the bottom side to the top side, the at least one aperture having at least one edge configured to engage the fastened cap to remove the cap from the bottle;

wherein the at least one aperture is sized to receive a sufficient portion of the top part of the bottle and the cap fastened thereon to engage the cap with the edge, wherein the at least one aperture comprises a stylized design comprising a logo.

* * * * *